United States Patent [19]

Selesky

[11] Patent Number: 4,784,564

[45] Date of Patent: Nov. 15, 1988

[54] REEL UNLOADING AND HANDLING STRUCTURE

[75] Inventor: Kenneth G. Selesky, San Juan Capistrano, Calif.

[73] Assignee: MTS Systems Corporation, Eden Prairie, Minn.

[21] Appl. No.: 28,739

[22] Filed: Mar. 23, 1987

[51] Int. Cl.[4] ..... B66C 23/00

[52] U.S. Cl. ..... 414/728; 198/468.2; 294/1.1; 294/902; 414/751

[58] Field of Search ..... 198/468.2; 294/1.1, 294/902; 414/280, 226, 416, 621, 661, 751, 753, 744, 728

[56] References Cited

U.S. PATENT DOCUMENTS 4,173,427 11/1979 Beuch et al. ..... 198/468.2 X
4,226,570 10/1980 Holecek et al. ..... 414/751
4,462,742 7/1984 Hradel ..... 198/468.2 X
4,515,508 5/1985 Takamatsu ..... 414/280
4,638,558 1/1987 Eaton ..... 29/861
4,658,503 4/1987 Eaton ..... 29/854
4,701,096 10/1987 Fisher, Jr. ..... 414/416

*Primary Examiner*—Carl J. Arbes
*Attorney, Agent, or Firm*—Gausewitz, Carr & Rothenberg

[57] ABSTRACT

A wire handling system removes a reel of wire from a conveyor, presents the reel to a terminal insertion head which grasps a wire on the reel, withdraws the wire from the reel while the reel is allowed to rotate, and inserts an end of the wire into a connector. After insertion of the wire end into the connector, the reel is moved by the handling system and stacked upon or within a group of previously stacked reels.

14 Claims, 8 Drawing Sheets

FIG. 3.
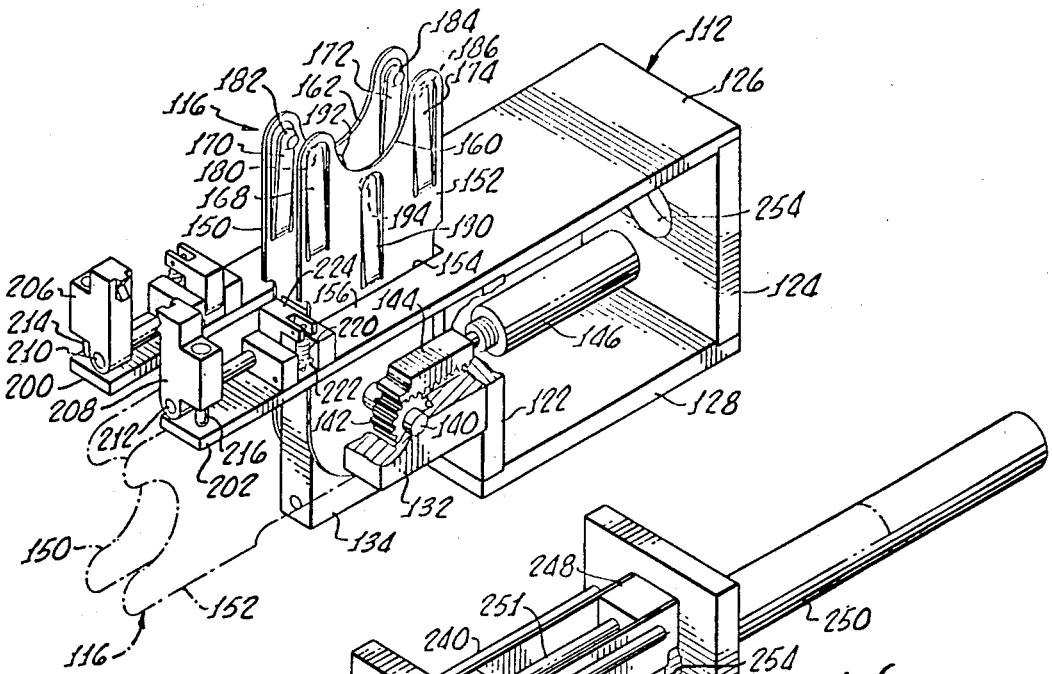
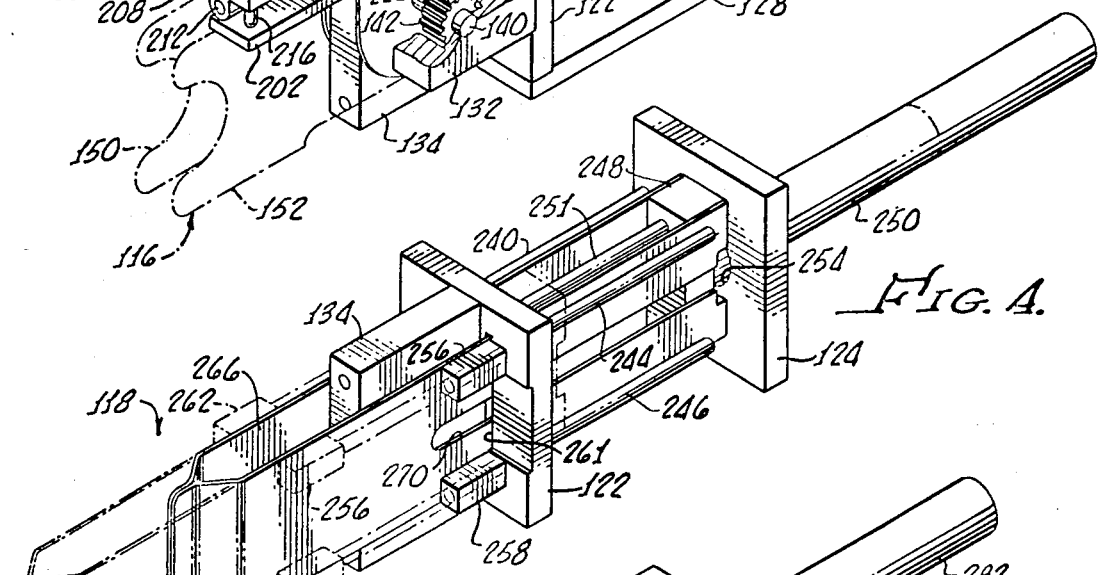
FIG. 4.
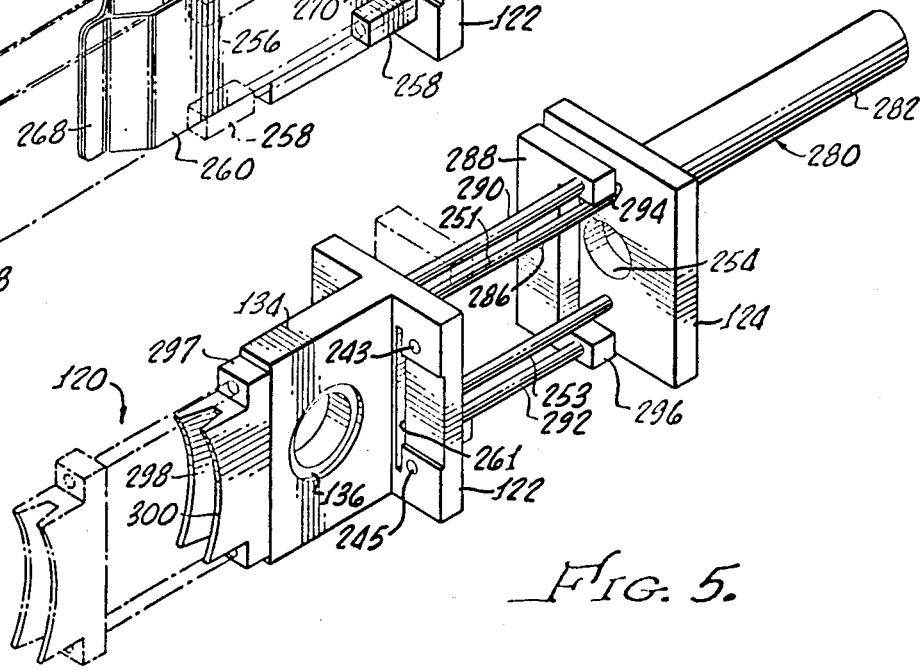
FIG. 5.

FIG. 10.
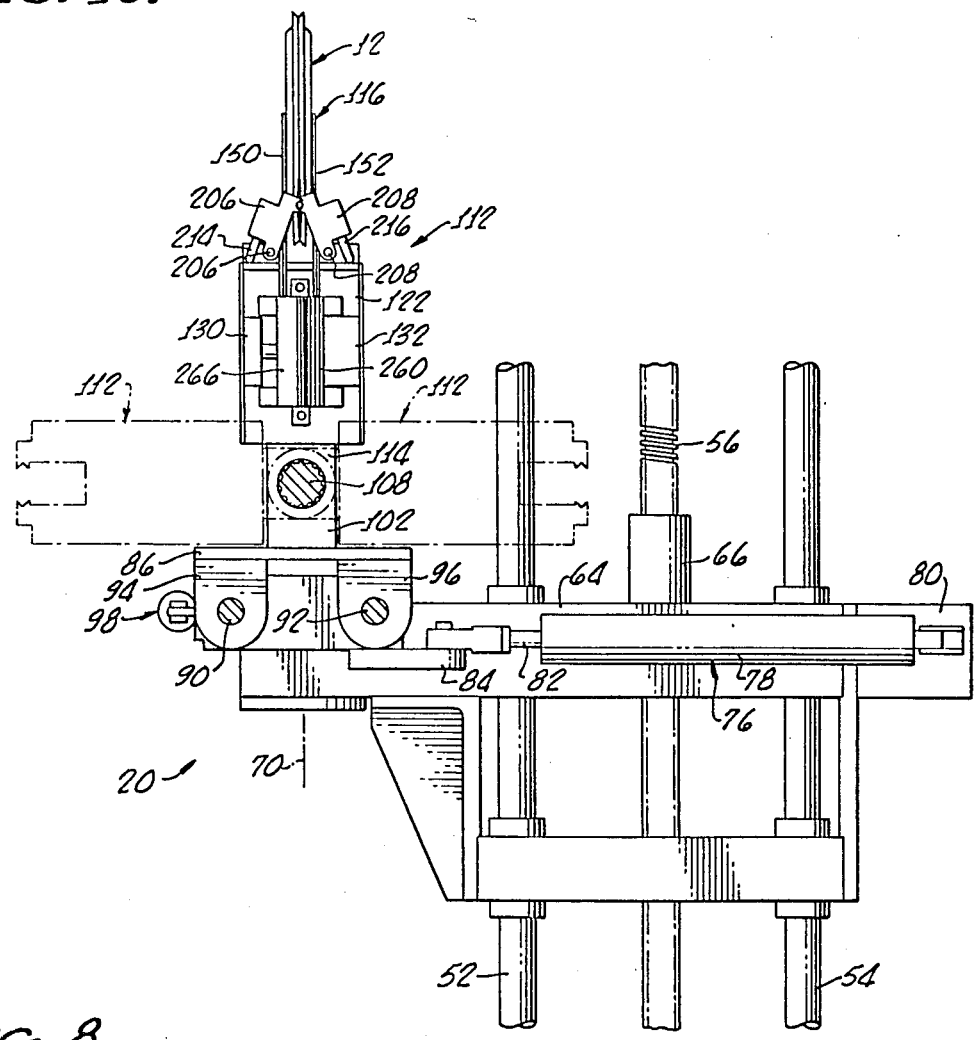
FIG. 8.
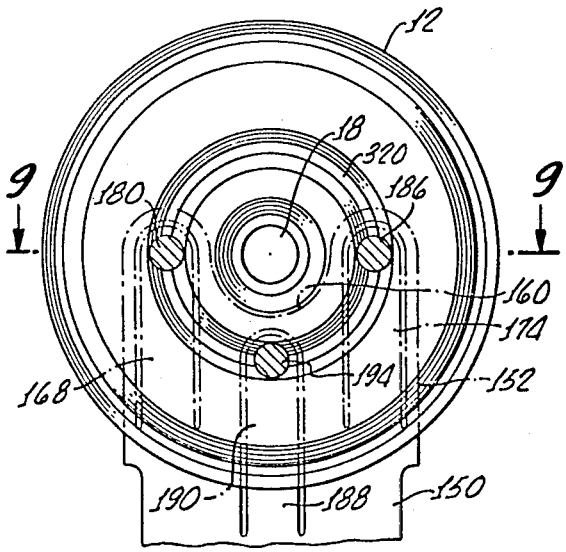
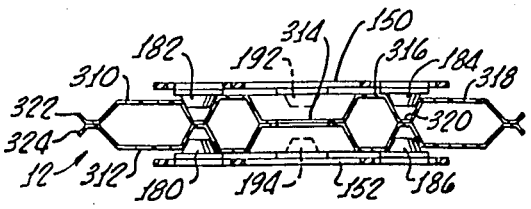
FIG. 9.

REEL UNLOADING AND HANDLING STRUCTURE

BACKGROUND OF THE INVENTION

The present invention relates to reel handling equipment, and more particularly concerns apparatus for removing a wire from a conveyor, holding the reel while permitting rotation, presenting it for operation to be carried out with respect to a wire wound on the reel, and then placing the reel in a storage location.

In a system for manufacture and assembly of harnesses of electrical wire or optical fiber, a wire or fiber is cut to a selected length and wound upon a reel with both ends projecting therefrom. As used herein the term "wire" is deemed to include both electrically and optically conductive elements. The reel is then mounted on a conveyor for transport to various end finishing stations at which wire ends are stripped and connecting terminals are affixed. In this system the reel is then moved to an insertion apparatus in which an end of the wire is inserted into an aperture of a multi-pin connector, and the reel, with wire still partly wound thereon, is then moved to a storage location near the connector. A wire processing and reel winding apparatus of such a system is described in co-pending U.S. patent application for Wire Processing Method and Apparatus, Ser. No. 615,933, filed May 31, 1984, now U.S. Pat. No. 4,638,558. Terminal insertion apparatus for use in such a system is described in U.S. patent application for Method and Apparatus For Contact Insertion, Ser. No. 027,939, filed Mar. 19, 1987. and a reel of wire and carousel storage therefor is described in co-pending U.S. patent application for Reel and Reel Handling System, Ser. No. 748,339, filed June 24, 1985.

In another co-pending U.S. patent application for Method and Apparatus For Terminal Insertion Ser. No. 646,949, filed Sept. 4, 1984 now U.S. Pat. No. 4,658,503, there is described a harness assembly system in which a reel of wire is presented to an insertion head which grasps the wire and inserts first one end of the wire and then the other into respective connectors after routing the wire in a selected path between the connectors and concomitantly withdrawing the wire from the rotating reel. The disclosure of each application identified above is incorporated by this reference as though fully set forth herein.

It is an object of the present invention to provide a method and apparatus for handling and manipulating a reel of wire or fiber in a variety of modes and procedures, and, in particular, in a manner suitable for use in systems referred to in the above-identified patent applications.

SUMMARY OF THE INVENTION

In carrying out principles of the present invention in accordance with a preferred embodiment thereof, first and second mutually spaced pickup members are connected to a support and spaced from one another by a distance not less than the thickness of the wire reel to be handled. Means are provided on the pickup members for grasping a reel positioned between the members, and apparatus is provided to move the support between a plurality of positions to thereby move a reel positioned between the pickup members. In a specific embodiment, the pickup members include opposed reel contacting clamp elements for slidably engaging and inwardly pressing outer surfaces of respectively opposite sides of a reel. According to another feature of the invention, a slidable pusher block is mounted for motion between the pickup plates to eject a reel clasped therebetween. As another feature of the invention, the reel contacting clamp elements are formed by inwardly urged resilient spring fingers, having mounting pins on free ends thereof, which are configured to be slidably received in coaxial grooves formed on opposite sides of the reel so that the resiliently clasped reel may rotate while being held in the grasp of the spring fingers.

BRIEF DESCRIPTION OF THE DRAWINGS

FIGS. 3, 4 and 5 are pictorial illustrations of respective major functional portions of a pickup plate carriage of the present invention;

FIG. 8 is a side elevational view of a wire reel held in a pair of pickup plates;

FIG. 9 is a sectional view of the reel and plate taken on lines 9—9 of FIG. 8;

FIG. 10 is a view showing the front of the pickup plate carriage;

DETAILED DESCRIPTION

Figure 1:
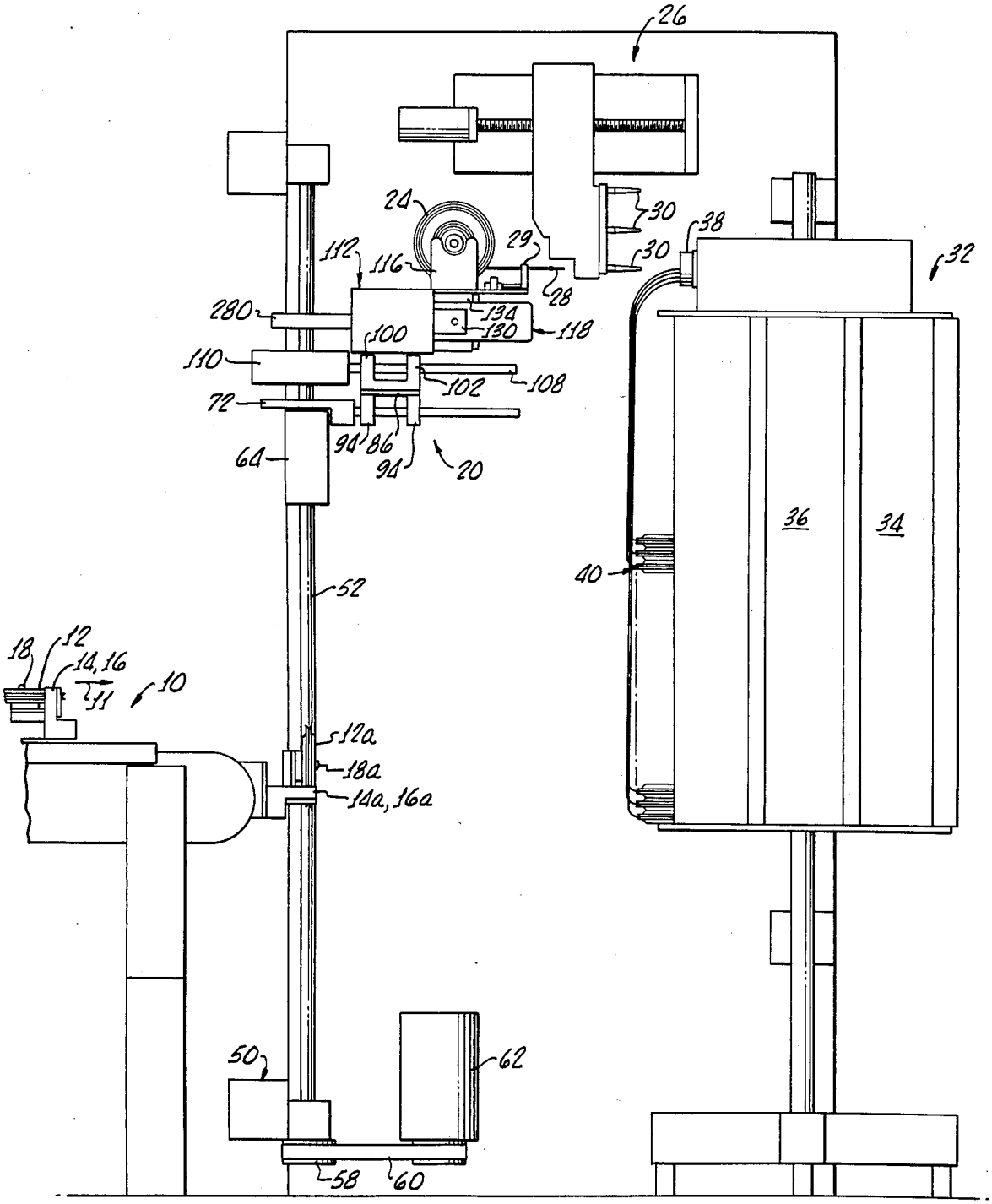
FIG. 1 is a simplified, schematic illustration of parts of a wire processing system which includes reel handling apparatus embodying principles of the present invention.

FIG. 1 schematically illustrates a portion of an automatic wire harness assembly apparatus which employs reel handling methods and apparatus of the present invention. Details of such wire harness assembly apparatus are described in the several patent applications identified above. In general, an overall system in which the present invention presently finds a preferred application automatically measures and cuts a number of lengths of insulated electrical wire or optical fiber, winds each length individually on a separate reel with both wire ends protruding, conveys the reels past end finishing stations at which ends of the wire which protrude from the reels are stripped and have connecting terminals affixed. The reels are then presented, one at a time, to an insertion head which grasps a protruding wire end and terminal and inserts the terminal into one aperture of a multi-pin connector. The reel, having a wire still partly wound thereon, but with one end of the wire inserted in the connector, is then placed upon a stack of reels adjacent the connector in a reel supporting carousel for further handling and processing as may be desired.

The specific embodiment of the present invention described herein relates to methods and apparatus useful in the described system for unloading a reel from a conveyor, presenting the reel to the insertion head, and then placing the reel on the carousel.

Figure 11:
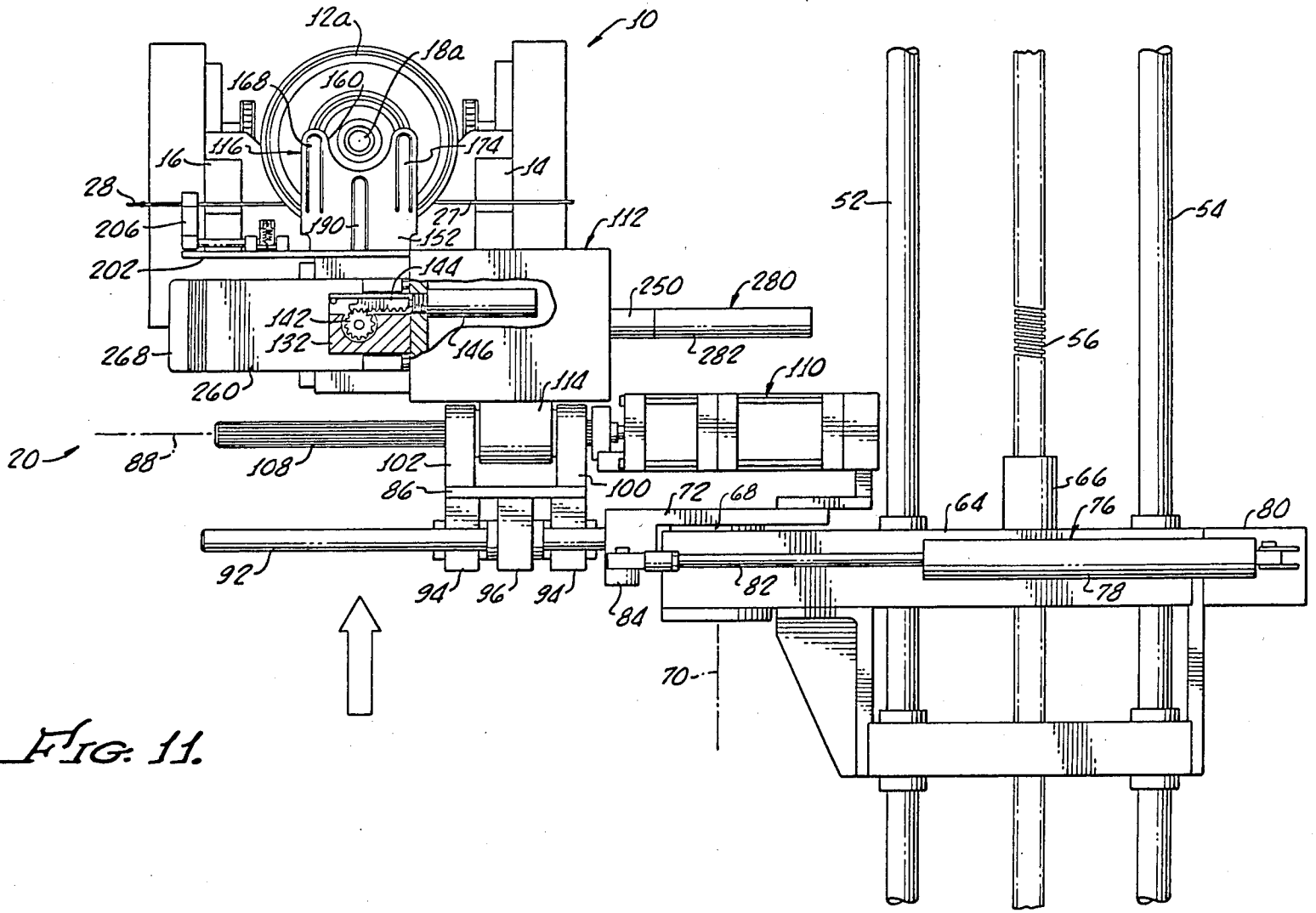
FIG. 11 illustrates the reel handling apparatus in position to unload a wire reel from the conveyor.

Illustrated in FIG. 1 are portions of such a system, including an unloading end of a conveyor 10 moving in the direction of arrow 11 and carrying a reel 12 by means of a pair of clamps 14,16 mounted on the conveyor for movement along the conveyor and grasping both ends of the wire which protrude from the reel (as illustrated in further detail in FIG. 11). A second pair of clamps **14*a*, 16*a* on the conveyor, downstream from the first mentioned clamps, carry the ends of a wire wound on a second reel 12*a*. The conveyor carries a plurality of additional reels (not shown) in a similar manner spaced along the length of the conveyor. Each reel has an apertured hub which is snug, friction-fit upon a stub shaft 18, 18*a*, mounted on the conveyor for rotation about an axis fixedly related to the wire holding clamps and coaxial with the wire reel. Thus the reels can be removed from the conveyor by pulling the reels off the stub shaft axially and releasing the wire end clamps 14*a*, 16*a*, but the reels cannot be grasped at or within the reel hub because the aperture of the hub is already filled with the snug fitting frictionally holding stub shaft 18*a*** of the conveyor.

The reel handler of the present invention, generally indicated by reference numeral 20 in FIG. 1, has a number of functions. First it will remove the reel from the snug fitting stub shaft of the conveyor, then it will transport the reel to a wire insertion position which is illustrated by reel 24 of FIG. 1, in which a terminal insertion head 26, described in further detail in the above mentioned application for Method and Apparatus for Contact Insertion will move rearwardly (toward the left as seen in FIG. 1) until a funnel (not shown) on the insertion head guides the projecting wire end 28, now held in a wire clamp 29 on the reel handler, between a pair of drive rollers (not shown) on the insertion head and into a selected one of a plurality of protective insertion sheaths 30. A carousel 32, having a plurality of vertically oriented reel receiving and stacking slots 34,36, among others, has a multi-pin connector 38 fixedly mounted thereon. Insretion head 26, grasping the wire end with the termnal protected in a sheath 30, moves forwardly to position the end of the terminal at the selected connector aperture, whereupon the rollers of the insertion head are rotated to drive the wire through the sheath 30 into the connector aperture, thereby partly unwinding the wire from the reel 24, which is rotatably mounted upon the reel handler 20. The latter does not move during terminal insertion. After the terminal has been inserted into the appropriate aperture of connector 38 and a pull test successfully performed, the insertion head is retracted, opened, and laterally withdrawn from the wire, which now extends between the connector 38 and the reel 24. Reel handler 20 then moves downwardly, withdrawing an additional portion of the wire from the reel, and the reel support is rotated about a horizontal axis to position the reel in a horizontal plane for stacking on top of a previously positioned stack of reels 40 in the carousel 32. The reel handler then moves forwardly, inserts the now horizontal reel 24 either on the top of the stack 40 or into a predetermined position between a pair of adjacent previously stacked and positioned reels and ejects the reel from the reel handler. Having positioned and released a reel upon the stack of reels, the reel handler is retracted and moved to the unloading end of conveyor 10 to grasp the next reel, which, during the just described operation of the reel handler has been moved into the position illustrated for reel **12*a***, where it is ready for unloading by the reel handler.

Figure 2:
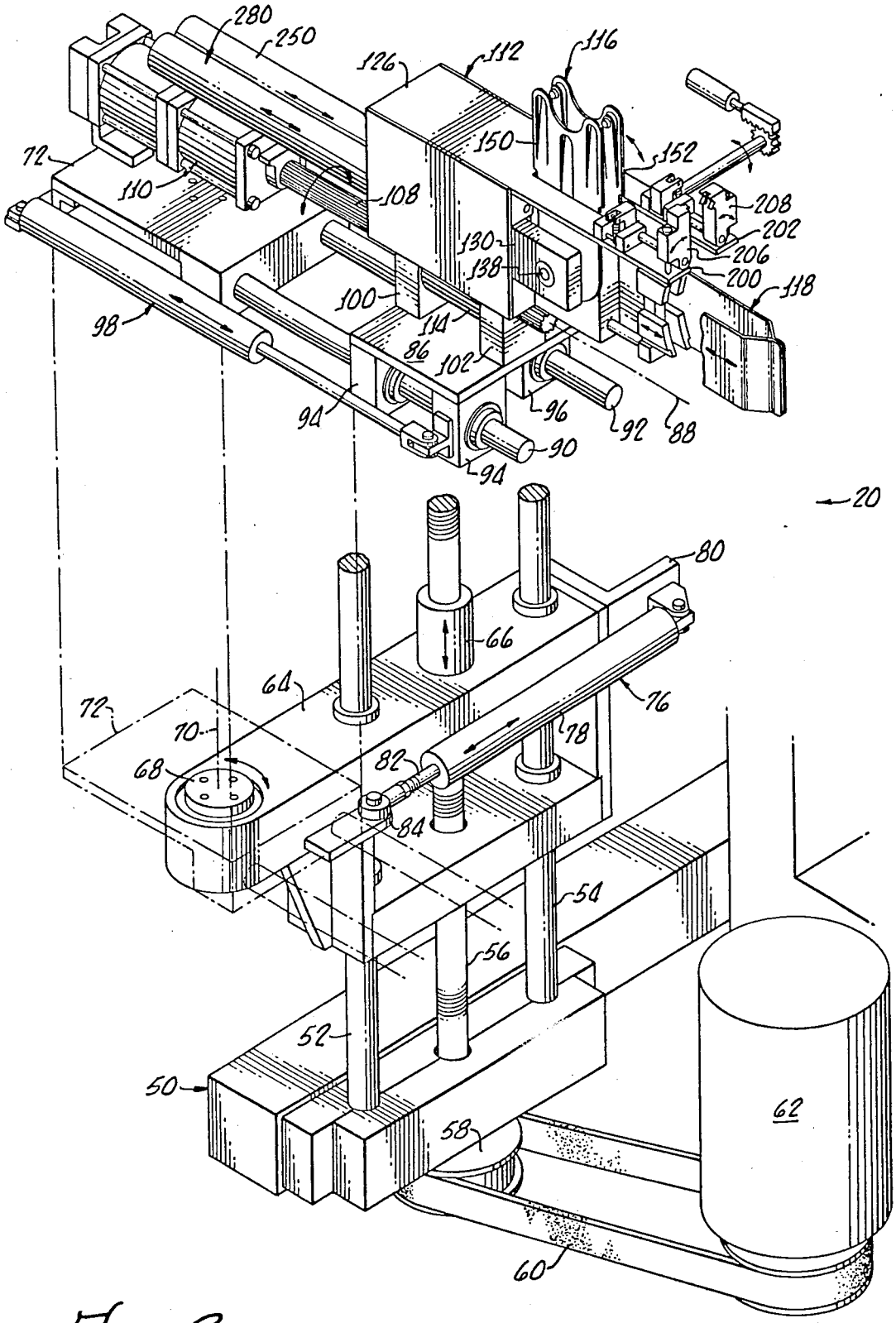
FIG. 2 is a stylized, pictorial illustration, distorted for exposition, with parts broken away, showing major components and relations of a reel handling apparatus embodying principles of the present invention.

Reel handler 20, of which primary functions and operations have been described in connection with FIG. 1, is illustrated in FIG. 2 in a simplified, partly exploded, pictorial view, with parts removed and other parts displaced or distorted in order to facilitate description and understanding. FIG. 2 illustrates the configuration, functional and operational position of major operating parts of the reel handler, whereas illustrations of the other figures accurately represent actual relative positions and relative proportions of the parts and specifically show the interfitting relations among the various parts. As seen in FIG. 2, a fixed base 50 carries a pair of mutually spaced parallel and vertically upstanding guide rods 52,54 and a vertically extending rotatable screw 56, parallel to the guide rods, which has a lower end fixed to a pulley 58 driven by a belt 60 from a fixedly mounted motor 62. Slidably mounted on guide rods 52,54 for vertical motion in response to rotation of screw 56 is an elevator platform 64 carrying a fixed internally threaded sleeve or nut 66 which is in threaded engagement with the vertical drive screw 56.

Figure 14:
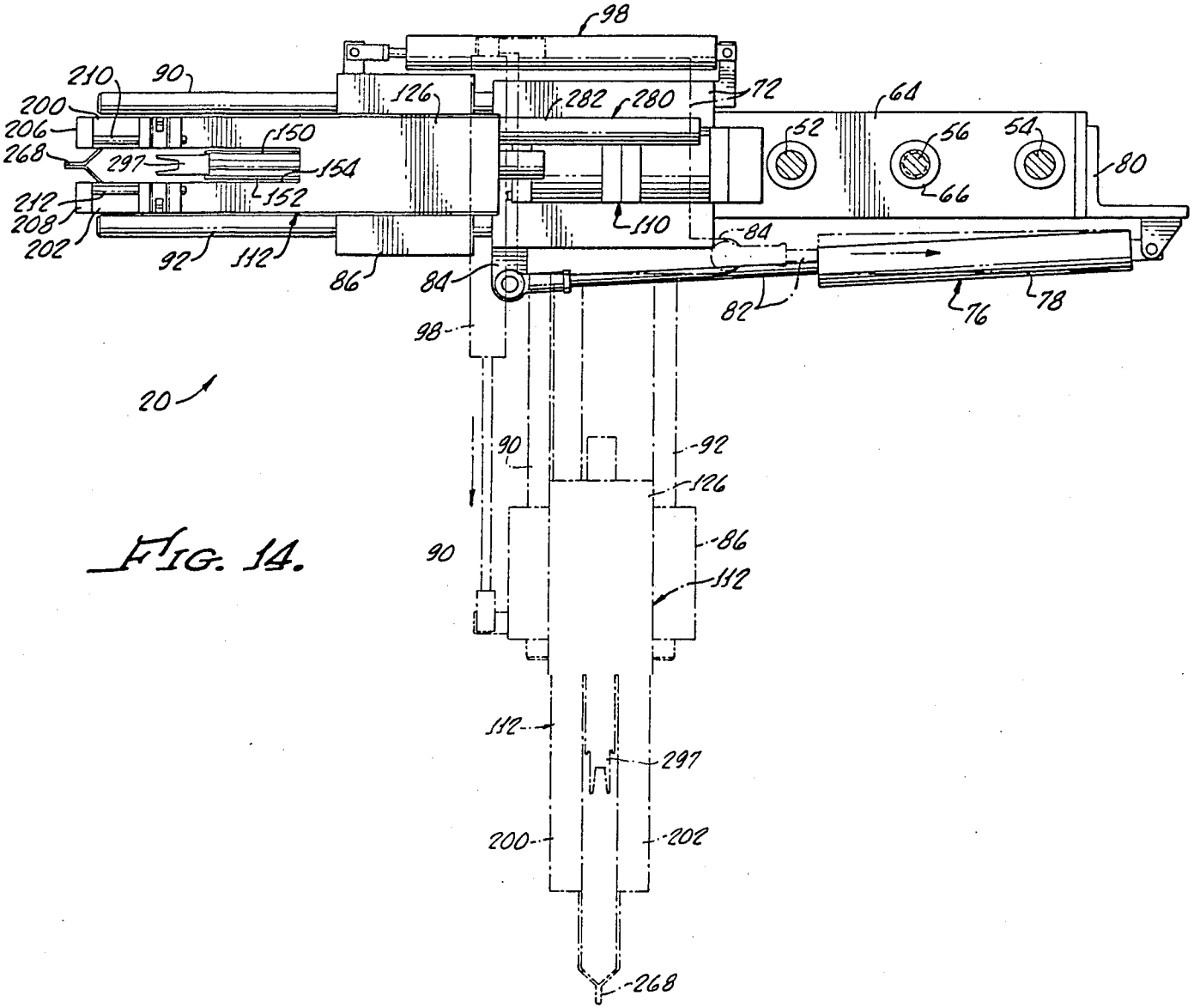
FIG. 14 is a plan view of portions of the reel handling apparatus showing different positions of the pickup plate carriage.

A bushing 68 is mounted in the elevator platform 64 for rotation about a vertical axis 70 and carries a rotating platform 72, which is bolted to the rotatably mounted bushing. A rotating platform drive motor, such as an air motor 76, includes a cylinder 78 pivoted to a bracket 80 that is fixedly attached to the elevator platform 64 and has an extensible piston rod 82 pivoted to a bracket 84 that is fixed to the rotating platform 72. This enables rotation of platform 72 between the positions shown in solid and dotted lines, respectively, in FIG. 14.

A sliding platform 86 is mounted for slidable motion back and forth in the direction of an axis 88, perpendicular to axis 70, on a pair of mutually spaced parallel guide rods 90,92 which are fixedly cantilevered from and extend forwardly of rotating platform 72. Platform 86 carries a plurality of fixed depending legs, such as legs 94,96 which are apertured to slidably receive the guide rods 90,92 and thereby slidably mount the platform 86 to the rotating platform 72. A bi-directional air motor 98 connected between rotating platform 72 and sliding platform 86 drives the latter back and forth along the guide rods.

Fixed to sliding platform 86 and longitudinally spaced along the direction of axis 88 are a pair of upstanding bearing blocks 100,102 which carry rotatable bushings (not shown) through which a splined shaft 108 extends in rotationally fixed but longitudinally slidable relation to the bushings. A motor 110 mounted on rotating platform 72 is connected to rotate splined shaft 108 to a selected one of the two 180° positions shown in solid and dotted lines in FIG. 13 and, also, to the intermediate (90°) position shown in FIG. 2. A pickup plate carriage 112 in the form of a generally rectangular housing fixedly carries a sleeve 114 depending from the bottom thereof between the upstanding blocks 100,102, which is slidably splined to the splined shaft 108 so as to be fixed to the spline shaft for rotation therewith. Thus the carriage 112 can be rotated 90° from the position of FIG. 2, in either direction about the axis of shaft 108, to either of the positions shown in solid and dotted lines respectively in FIG. 13.

Figure 7:
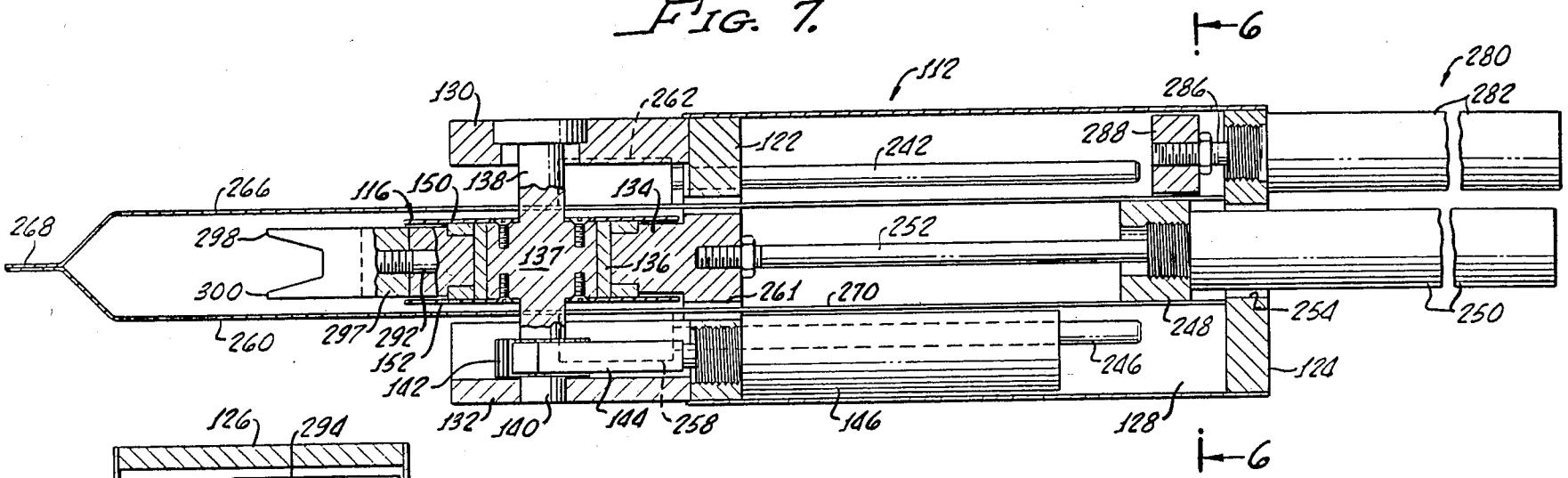
FIGS. 6 and 7 are sectional views, with parts broken away in FIG. 7, showing further relation of components illustrated in FIGS. 3, 4, and 5.
Figure 6:
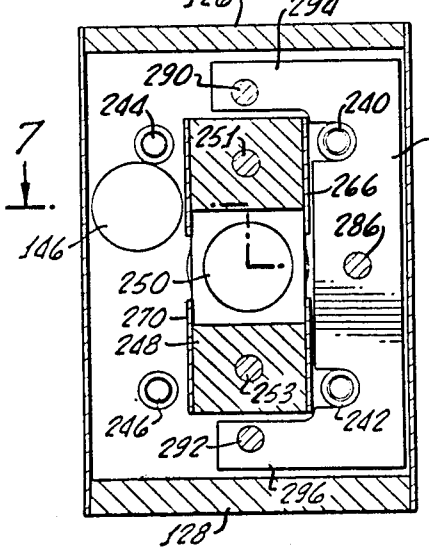

Details of the pickup plate carriage 112 are shown collectively in FIGS. 3 through 7. FIGS. 3, 4 and 5, are separate pictorial illustrations of different portions of the carriage operating components. Each of FIGS. 3, 4 and 5 shows a different one of the three different sets of operating components carried by the carriage 112, and omits other components. Only certain portions of the carriage housing itself are shown in common in all FIGS. 3, 4 and 5. FIG. 7 is a horizontal sectional view, with parts broken away, which when taken in conjunction with FIGS. 3, 4 and 5 and other figures of the drawings, shows the inter-relation of the three functional components of the pickup head carriage. The three primary functional components of the pickup plate carriage are the pickup plates 116, shown in FIG. 3, the reel protecting and insertion sheath 118, shown in FIG. 4, and the reel pusher or ejection block 120, shown in FIG. 5.

Pickup plate housing 112 has front and rear plates 122,124 interconnected by a top plate 126 and a bottom plate 128, from the bottom of which fixedly projects the carriage mounting sleeve 114 (FIG. 2).

Referring to FIGS. 3 and 7, front housing wall 122 carries a pair of forwardly projecting parallel and mutually spaced mounting side plates 130,132 between which extend a fixed center plate 134 having a transverse aperture in which is mounted a bearing 136, best seen in FIG. 5. Fixed to opposite sides of a trunnion 137 that is mounted in bearing 136, and extending in opposite transverse directions therefrom are stub shafts 138,140 which have outer ends thereof rotatably supported in side plates 130,132 respectively. Fixed to an end of shaft 140 and received in a recess formed in side plate 132 is a pinion 142 meshing with a rack 144 that is driven linearly forwardly and rearwardly by an air motor 146 mounted in the housing of pickup carriage 112. Bolted to trunnion 137 are a pair of thin, flat resilient pickup plates 150,152 which extend in mutually spaced parallel relation between side plates 130,132 and on respective sides of center plate 134. A slot 154 in the forwardly extending portion 156 of housing top plate 126 receives the pickup plates as shown in FIG. 3. Operation of pickup plate rotation motor 146 rotates the pickup plates 150,152 about the axis of stubshafts 138,140 between the solid line and dotted line positions illustrated in FIG. 3 for purposes to be more particularly described below.

Each resilient pickup plate has an upwardly (in the position of FIGS. 2 and 3) opening arcuate recess 160,162, at the sides of which are first and second pairs of resilient upwardly projecting mutually spaced and mutually parallel spring fingers 168,170,172,174. The spring fingers are cut out of the sides of the pickup plates, being cantilevered thereto at their lower ends and have a natural, unstressed position in which they are inclined upwardly and inwardly (as viewed in the position of FIG. 3) so that the upper free ends of the finger pairs 168,170 and 174,172 effectively approach each other and are more closely spaced than the spacing between the bodies of the pickup plates 150,152. Thus the free ends of the respective fingers of each pair are inwardly biased toward one another. Inwardly projecting from the outer or free end of each of the spring fingers are respective reel holding pins 180,182,184,186 (see also FIG. 9), which are adapted to enter and rotatably receive outwardly facing circular grooves formed in the sides of the wire reel, as will be more particularly explained below in connection with FIGS. 8 and 9. A third pair of spring fingers 188,190, also cut from the pickup plates and cantilevered therefrom at lower ends of the fingers, is positioned between the other pairs of fingers on the respective plates and is somewhat lower (in the position shown in FIG. 3) than the latter, similarly carrying reel mounting pins 192,194, as best seen in FIG. 9.

Slot 154 of housing top plate 126 divides the latter into a pair of spaced arm portions 200,202, on which are mounted the wire end clamp generally indicated at 29 in FIGS. 1 and 3. Wire end clamp 29 comprises a pair of nearly identical clamp structures in the form of clamp arms 206,208 pivoted to the top plate sections 200,202 respectively on fixed shafts 210,212 and driven respectively clockwise and counter-clockwise as viewed from the left in FIG. 3 (toward or away from each other) by small air motors 214,216 positioned between the top plate sections 200,202 and the respective clamp sections 206,208 and offset from the axes of shafts 210,212. Operation of the air motors drives the clamp jaws together to clamp therebetween a wire that extends from a reel that may be grasped in and between the pickup plates 116. The wire clamp sections 206,208 are retracted to open position by means of tension springs, such as spring 220 mounted between a pin 222 fixed to the top plate and supporting shaft 212 and a bell crank 224 and rotatably mounted on shaft 212. A similar spring operated retraction arrangement is provided for clamp part 206. Accordingly, powered extension of air motors 214,216 will forcibly close the jaws to clamp a wire, whereas release of the force of the air motors allows the tension springs to retract the jaws from their clamping position.

Illustrated in FIG. 4 are portions of the pickup plate carriage housing which relate to the sheath 118, its drive and its mounting. A pair of resilient and flexible sheath plates 260,266 are mounted on opposite sides of center plate 134, at respective outer sides of pickup plates 150,152, for forward and rearward slidable motion relative to the carriage 112 between the solid and dotted line positions illustrated in FIG. 4. Each sheath has its rearward portion longitudinally slotted for a major portion of the sheath length, as indicated at 270 for sheath plate 260, with the rearwardly opening slots receiving the pickup plate shafts 138,140 during slidable motion of the sheath plates. The sheath plates extend through a pair of slots, such as slot 261 (FIGS. 4 and 5) in housing front plate 122 on respective sides of center plate 134. Rearward ends of the sheath plates are fixedly connected to opposite sides of a spacer and drive block 248, to which is fixedly secured the cylinder 250 of a bi-directional air motor having a piston rod 252 (FIG. 7) of which the foward end is fixed to front housing plate 122. Cylinder 250 is slidably mounted in an aperture 254 formed in rear housing plate 124. Guide rods 251,253 (see FIGS. 4, 5 and 6) are fixed at opposite ends thereof to front and rear plates 122,124 and are slidably received in apertures of drive block 248 to guide the block and the sheath plates during their forward and rearward motion. Position of sheath plate 260 at an intermediate portion thereof is stabilized during its motion by a pair of blocks 256,258 which are mutually spaced and fixed to upper and lower portions of the outside of the sheath plate. Blocks 256,258 carry fixed guide rods 244,246 (see also FIG. 6) respectively, which are slidably received in apertures 243,245 (FIG. 5) in forward housing front plate 122, and thus help to support the sheath plate in its forward, dotted line position, of FIG. 4. Similarly, sheath plate 266 has an identical pair of stabilizing blocks and guide rods, including blocks 262 and guide rods 240,242 (FIG. 6) to help support this plate in its forward position. Thus energization of cylinder 250 in one direction will pull cylinder 250 from its solid line to its dotted line position of FIG. 4, driving block 248 and both sheath plates 260 and 266 forwardly to their dotted line positions. Energization of the air motor 250,252 in the other direction drives block 248 together with the sheath plates 260,266 rearwardly to the solid line position of FIG. 4.

The sheath plates have the forward ends thereof inwardly bent toward each other to provide a joint forward edge portion 268 forming a narrowed edge of the sheath that may be readily inserted between adjacent reels of a stack of reels, as will be described below in connection with FIGS. 12*a* through 12*d*. Pickup plates 150,152 are mounted between the sheath plates 260,266 and arranged so that the pickup plates, together with a reel that may be grasped and clamped therebetween, are completely enclosed in the space between the sheath plates 260,266, as will be more particularly described in connection with the description of FIGS. 12*a* through 12*d*.

Figures 12A, 12B, 12C, 12D, 13:
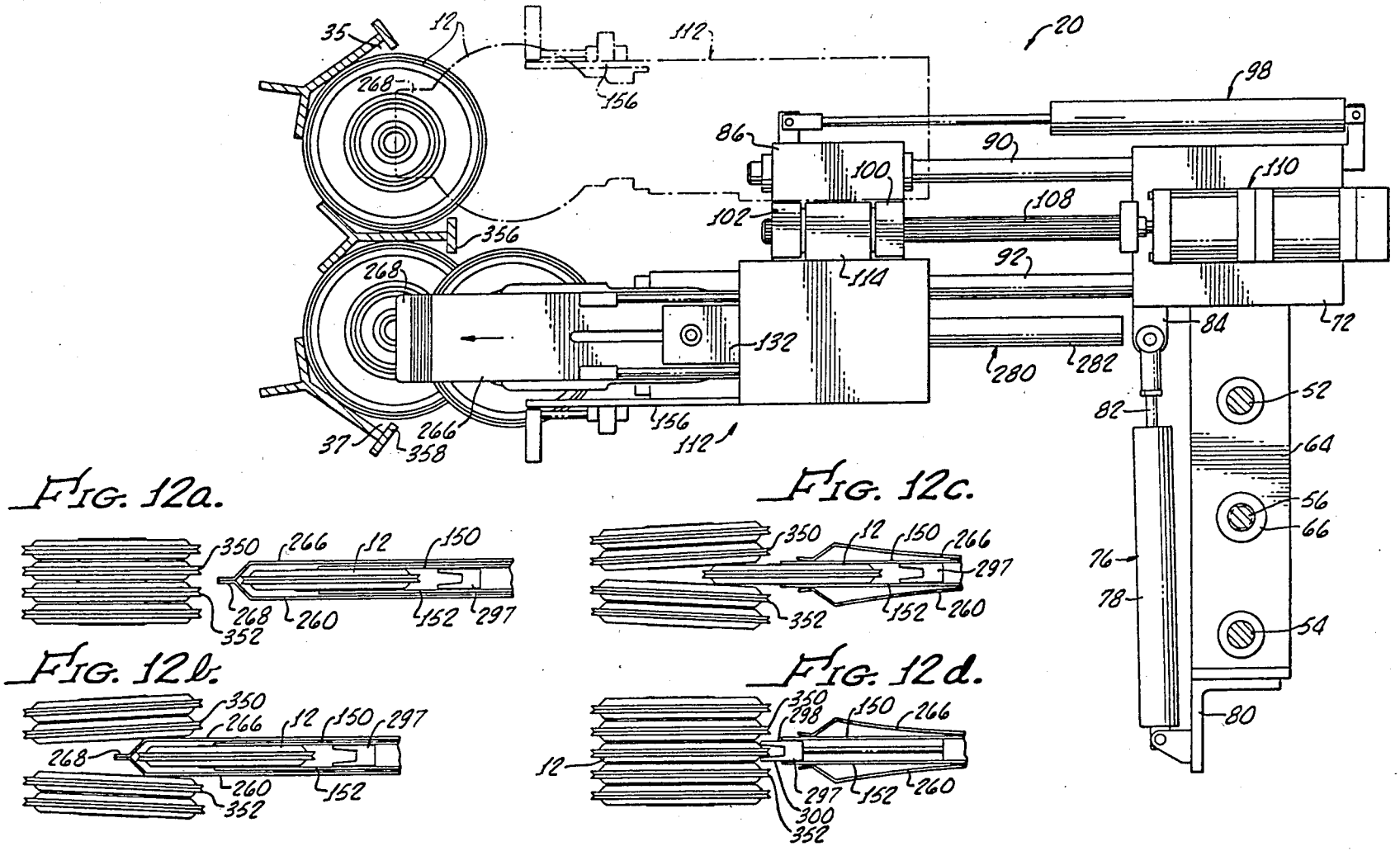
FIGS. 12*a*, 12*b*, 12*c* and 12*d* illustrate positioning and storage of a reel between adjacent reels of a stack.
FIG. 13 illustrates the apparatus in position to insert a reel on top of a stack of reels.

Illustrated in FIG. 5 are those portions of the pickup carriage which show the mounting and configuration and illustrate operation of pusher block 120. A pusher block bi-directional air motor 280 has its cylinder 282 fixed at the forward end thereof to rear housing plate 124 and carries a piston rod 286 (FIG. 7) extending through an aperture in housing rear plate 124 and fixedly connected to a C-shaped drive plate 288. Plate 288 fixedly carries a pair of mutually spaced pusher block drive rods 290,292 fixed to the upper and lower legs 294,296 of the C-shaped drive plate. With both sheath and pusher block retracted, sheath drive block 248 fits adjacent the body of C-shaped drive plate 288 and between legs 294,296 thereof. Drive rods 290,292 are located in a longitudinal central plane of the pickup plate housing and extend through apertures in the forwardly extending center plate 134, having their front ends fixedly connected to a pusher block body 297. The pusher block body has a pair of mutually spaced forwardly extending arcuate tongues 298,300 configured for mating contact with the edges of a reel to push such reel into a stack of previously positioned reels, as illustrated in FIG. 12*d*.

A significant feature of the apparatus of the present invention is its ability to unload a reel of wire from the conveyor on which the reel is mounted by the tight fit of the rotating conveyor stud 18 within the reel hub aperture. The described apparatus will grasp the reel while the reel is mounted on its hub, remove the reel from its hub mounting, and, without changing the grasp of the handler apparatus upon the reel, will provide for rotation of the reel while it remains grasped in the handling mechanism. Although the reel is grasped at points radially outwardly of its hub, it is still rotatably mounted. The structure which enables this operation is best illustrated in FIGS. 8 and 9, of which FIG. 9 shows a typical reel in cross section held in the grasp of and between a pair of reel pickup plates 150,152. As more particularly described in a co-pending application for Reel and Reel Handling System Ser. No. 748,339, Filed June 24, 1985, a typical reel is made of a pair of bent resilient side plates 310,312 which are identical to one another. Plate 310 has a central apertured hub section 314, and radially inner and axially outwardly bent stacking section 316 separated from a radially outer and axially outwardly bent wire receiving cavity section 318 by an annular intermediate section 320. The two side plates are fixedly joined together at the hub sections 314 and at the intermediate side sections 320 so that the outer cavity sections 318 may be resiliently separated from each other to allow a wire (not shown in FIG. 9), which is wound within the reel cavity, to pass outwardly of the cavity section between the resilient peripheral lips 322,324 of the reel. Annular intermediate sections 320 are circular and concentric with the reel hub and form outwardly facing circular grooves which receive the reel holding pins 180,182,184,186,190 and 192, of the three oppositely disposed pairs of spring fingers 168,170,174,172,188, and 190.

The side plates and inwardly biased and cantilevered spring fingers are positioned to enable the side plates, when positioned substantially in the plane of a reel to be unloaded from the conveyor, to be moved toward the reel hub along a reel radius, with the tapered ends of the spring finger pins engaging the outer sides of the reel cavity sections 318 to force the spring fingers outwardly as the reel plates continue to move radially inwardly toward the hub. As can be seen in FIG. 9 the reel pickup plates are relatively spaced by a distance slightly greater than the maximum thickness of the reel at the stacking sections 316 so that only the spring fingers need be cammed outwardly as the reel moves into and between the pickup plates. Motion of the pickup plates toward the reel hub along a reel radius continues with the spring finger pins riding along the outer surfaces of the cavity sections 318 until they all, substantially simultaneously, reach and snap into the annular grooves at the intermediate sections 320. The spring fingers and the pins thereon are positioned so that the three pins on each pickup plate define a circular arc having the same curvature as the curvature of the groove formed by reel intermediate section 320. Thus, with the six pins all received within the outwardly coaxial facing reel grooves and resiliently pressing inwardly, the reel is firmly grasped and positioned between the pickup plates, but, nevertheless, is free to rotate with the pins sliding in the reel circular grooves during such rotation. Rotation of the reel while it is held facilitates withdrawal and unwinding of wire from the reel for insertion in a connector, as will be described more particularly below, and is described in further detail in the above mentioned application For Method and Apparatus For Contact Insertion.

In operation of the reel handling apparatus described herein, conveyor 10 of FIG. 1 comes to rest in a position, such as illustrated in FIGS. 1 and 11, with a reel 12*a* carried in a vertical plane on a conveyor stud 18*a*, and with the wire ends 28 and 27 grasped in conveyor mounted clamps 16,14. The reel handling apparatus has its base 50 fixedly mounted relative to the fixedly mounted conveyor 10. The fixed parts are positioned so that when the rotating platform 72 is pivoted about the vertical axis 70, by extending air motor 76 to the position shown in FIG. 11 and in solid lines in FIG. 14, and with the pickup plates 150,152 rotated to the vertical position illustrated in FIGS. 3 and 11 by retraction of reel pickup plate drive rack 144, and with the sliding platform 86 retracted, the pickup plates are directly beneath the reel and aligned therewith. Operation of elevator motor 62 will raise elevator platform 64 and the entire pickup plate carriage to drive the pickup plates over and on each side of the reel 12*a*until the spring finger pins snap into the reel grooves. With the reel firmly grasped in the reel pickup plates, wire end 28, which protrudes from the reel and is still held firmly in conveyor clamp 16, has an end protruding from clamp 16 between the open wire clamp jaws 206,208 of the pickup plate carriage wire clamp 29. These jaws are now closed by operation of air motors 214,216 to grasp the wire as shown in FIG. 10, and the conveyor clamps 14,16 are opened to release the wire from the conveyor. Now the rotating platform motor 76 is retracted to rotate the pickup plate carriage about vertical axis 70 from the solid line to the dotted line position illustrated in FIG. 14, thereby removing the reel and wire from the conveyor. As the carriage rotates and the reel clears the conveyor, the elevator platform 64 is raised to bring the entire reel handling mechanism 20 to the position illustrated in FIG. 1, with the reel carriage and sliding platform 86 still in the rearward or retracted position. The reel handler, in the position shown in FIG. 1, presents the wire end 28, now held in clamp 29, and the terminal thereon along a predetermined horizontal axis such that insertion head 26 may be moved to bring its sheath 30 and rollers and funnel (not shown) into alignment with the wire end 28. The insertion head is then moved horizontally, toward the left as viewed in FIG. 1, to cause the terminal on wire end 28 to pass between the insertion head rollers and into the protective sheath 30. The insertion head rollers, which are now rotating, tightly grasp the wire at a point inwardly of the terminal of the wire end and, with the reel handler remaining in fixed position, insertion head 26 then moves in three dimensions as required to position the free end of sheath 30 at or slightly within a selected aperture of connector 38 so that the insertion head rollers may drive the wire through the sheath into a firm connection within the connector aperture. Operation of the rollers to drive the wire and motion of the insertion head 26 toward connector 38 withdraws wire from the reel 24, which rotates by means of a sliding motion of the spring finger pins in the circular reel grooves, and thus enables the wire to be withdrawn from the reel for insertion into the connector. The reel handler remains fixed during the wire end insertion.

Having successfully inserted the wire end into the connector, the insertion head now withdraws from the connector and laterally spreads apart its funnel, rollers and protective sheath to enable the insertion head to move laterally off the wire, which remains partly wound upon the reel and has one end now fixed to connector 38.

The reel handler now moves downwardly to a vertical position adjacent the top of a stack of reels 40 that are contained within one of the slots 34,36, etc. of carousel 32. In order to enable the reel handler to place the reel on a stack in one or the other of two mutually adjacent carousel slots, the reel carriage is mounted for rotation in either direction about horizontal axis 88 (FIG. 2) from the solid line position shown in FIG. 10 to either one or the other of the two dotted line positions shown in this figure. These alternative reel insertion positions of the pickup plate carriage, which are displaced by 180° from one another, are shown in solid and dotted lines respectively in the plan view of FIG. 13, which illustrates the ability of the apparatus to alternatively place a reel in one or the other of a pair of adjacent carousel slots 35,37.

In the course of the downward motion and rotation about horizontal axis 88 of pickup plate carriage 112, the reel plates with the reel still grasped therein, are rotated (by operation of motor 146 and rack and pinion 144,142) about the horizontal axis of pickup plate mounting shafts 138,140 to swing the reel pickup plates, with the reel grasped therebetween, into the space between the sheath plates 260,266, to the position shown in FIG. 12*a* and in FIG. 13. If the reel is to be placed between a pair of adjacent, previously stacked reels, such as adjacent reels 350,352 of FIGS. 12*a* through 12*d*, the narrow edge 268 of the closed sheath plates 260,262 is horizontally aligned with the plane of contact between these reels by control of elevation platform 64, and then sliding platform motor 98 is exetnded to drive the pickup plate carriage and the sheath plates 260,266 (with the reel carried between the sheath plates) forcibly between the adjacent reels 350,352, as shown in FIG. 12*b*. In this motion edge 268 acts as a wedge against inclined outer surfaces of adjacent reels to force the reels apart. The amount of insertion is enough to move the reel 12 well inwardly of the outermost edges of previously stacked reels 350,352. Upon occurrence of the next step, which is retraction of air cylinder 250 and the sheath plates 260,266 to the solid line position shown in FIG. 4 and to the position of FIG. 12*c*, the reel 12 remains in position between the adjacent reels 350,352 because of the holding action of the spring finger pins. During the retraction of the sheath plates, they are resiliently spread apart as the forward edges thereof are retracted over the sides of the enclosed reel. The resilient clamping of the reel by the pickup plate fingers prevents retraction of the reel 12 together with the sheath plates as the latter are forced apart and drawn across the sides of the reel and over the reel plates to the position of FIG. 12*c*. Now pusher block motor 280 is operated to drive pusher block 120 forwardly so that its pusher tongues 298,300 contact the sides of the cavity sections of the reel side plates and drive the reel the remainder of the way into the stack, as shown in FIG. 12*d*. In this step the pickup plate spring fingers are forced apart and the reel is ejected from the pickup plates.

In many cases the reel in the handling apparatus will be positioned on top of the previously positioned stack rather than between adjacent reels that have been previously stacked. To position the reel on top of a stack of previously stacked reels, the same operation as described above in connection with insertion of a reel between adjacent previously positioned reels will be carried out, but this will be done at the top of the stack instead of between a pair of stacked reels. Although the wedging action of the narrow edge 268 of the sheath plates is not needed to place a reel on top of a stack, the sheath does not interfere with this operation. It may be noted that the carousel slot edges, such as edges 356 and 358 of the carousel slot 37 (FIG. 13) are spaced from one another by a distance slightly less than the diameter of a reel so that the reel must be slightly forced into the slot which accepts the slightly larger reel by virtue of resilient deformation of the reel and the carousel slot structure.

If insertion of a reel between previously stacked adjacent reels is not desired, the sheath plates are not needed. For such application the apparatus may be modified by eliminating the sheath plates 260,266 and their mounting and drive components, whereby the reel, grasped between the pickup plates, is positioned slightly above and on top of the uppermost reel of a previously stacked set of reels, and the pusher block 120 actuated to drive the reel from between the resilient clamping grasp of the pickup plates. After placing a reel upon or within the stack, sliding platform 86 is retracted to retract the carriage 112, and the apparatus is then moved back to the conveyor for unloading of the next reel.

The foregoing detailed description is to be clearly understood as given by way of illustration and example only, the spirit and scope of this invention being limited solely by the appended claims.

I claim:

1. Apparatus for handling a wire reel comprising:

a support, first and second mutually spaced pickup members fixedly connected to said support, said pickup members being spaced from one another by a distance not less than the thickness of a reel to be handled, said pickup members comprising mutually opposed inwardly biased resilient holding devices for slidably receiving and grasping a reel positioned between the members, and means for moving said support between a plurality of positions to thereby move a reel positioned between said pickup members.

2. Apparatus for handling a wire reel comprising:

a support, first and second mutually spaced pickup members fixedly connected to said support, said pickup members being spaced from one another by a distance not less than the thickness of a reel to be handled, means on said pickup members for grasping a reel positioned between the members, and means for moving said support beween a plurality of positions to thereby move a reel positioned between said pickup members, each said means for grasping a reel comprising a plurality of inwardly biased resilient reel holding fingers on said pickup members adapted to slidably receive a reel there between.

3. Apparatus for handling a wire reel comprising:

a support, first and second mutually spaced pickup members fixedly connected to said support, said pickup members being spaced from one another by a distance not less than the thickness of a reel to be handled, means on said pickup members for grasping a reel positioned between the members, and means for moving said support between a plurality of positions to thereby move a reel positioned between said pickup members, including pusher means mounted to said means for moving said support for motion between a retracted position in which the pusher means is located between said pickup members and an extended position in which the pusher means is positioned at adjacent ends of said pickup members.

4. The apparatus of claim 3 wherein said pickup members comprise flat plates and wherein said means for grasping comprise inwardly biased resilient holding finger means for slidably receiving and holding a reel therebetween.

5. An object manipulating apparatus comprising:

a carriage housing, first and second mutually spaced and mutually opposed spring fingers mounted to the housing and having free ends adapted to resiliently clasp therebetween an object to be manipulated, and a pusher block slidably mounted on the housing for motion between said spring fingers from a first position remote from said free ends of said spring fingers to a second position at the free ends of said spring fingers, thereby to eject an object resiliently clasped between the spring fingers therefrom.

6. The apparatus of claim 5 including third and fourth mutually spaced opposed spring fingers mounted to the housing in spaced relation to and in alignment with said first and second spring fingers, and adapted to cooperate with said first and second spring fingers to resiliently clamp an object between said first and second and between said third and fourth spring fingers, said pusher block in said first and second positions being respectively being positioned between first and second ends respectively of said third and fourth spring fingers.

7. The apparatus of claim 6 including fifth and sixth mutually parallel and mutually spaced opposed spring fingers mounted to said housing between said first and second and said third and fourth spring fingers and aligned therewith, each said spring finger having a free end, and each such free end having a mounting pin secured thereto and projecting toward the mounting pin of the respective opposed spring finger, the pins of said first, third and fifth spring fingers and the pins of said second, fourth and sixth spring fingers lying in aligned coaxially circular paths and thereby adapted to be positioned in opposed circular grooves of an object resiliently clasped therebetween, and thereby adapted to rotatably support such object.

8. The apparatus of claim 5 including a wire clamp mounted on said carriage housing adjacent said spring fingers whereby said wire clamp may clamp a wire protruding from a wire reel resiliently grasped by and between said spring fingers.

9. The apparatus of claim 5 including a sheath movably mounted to the carriage housing for motion between a first position in which the sheath at least partially encloses the spring fingers and an object held thereby and a second position in which the sheath is retracted to expose at least the free ends of said fingers and an object held therebetween, whereby when said sheath is in said retracted position motion of said pusher block toward the free ends of said fingers will eject an object that is resiliently clasped between the spring fingers.

10. The apparatus of claim 9 wherein said sheath comprises a sheath mounting block slidably mounted to said carriage housing, and a pair of mutually spaced parallel sheath plates fixed to said block and extending along opposite sides of said pusher block and along opposite sides of said spring fingers.

11. The apparatus of claim 7 including first and second mutually spaced opposed pickup plates mounted to said carriage housing, said first, third and fifth spring fingers each being resiliently connected to and cantilevered from said first plate and biased inwardly of said first plate toward said second plate, said second, fourth and sixth spring fingers each being resiliently connected to and cantilevered from said second pickup plate and biased inwardly thereof toward said first pickup plate.

12. The apparatus of claim 11 wherein said pickup plates are fixedly connected to one another and rotatably mounted to said carriage housing.

13. The apparatus of claim 12 wherein said carriage housing includes a front wall, first and second mutually spaced and parallel side walls projecting forwardly from said front wall, a center wall fixed to and projecting from said front wall between said side walls and spaced therefrom, a transverse shaft rotatably mounted to said side walls and extending through said center wall, said pickup plates being mounted to said shaft for rotation therewith, a pick up plate rotation motor mounted to the housing and connected to rotate the pickup plates, first and second mutually spaced pusher drive rods slidably mounted to said center wall and connected to said pusher block, and a pusher motor mounted to the housing and connected to drive the pusher rods.

14. The apparatus of claim 13 including a sheath drive block slidably mounted to said carriage housing, said front wall having a pair of mutually spaced sheath plate receiving slots, first and second sheath plates fixed to said sheath drive block and extending through said slots on opposite sides of said pusher block and on opposite sides of said pickup plates, and a sheath motor mounted to the carriage housing and connected to drive the sheath drive block.

* * * * *

UNITED STATES PATENT AND TRADEMARK OFFICE

CERTIFICATE OF CORRECTION

PATENT NO. : 4,784,564

DATED : November 15, 1988

INVENTOR(S) : Kenneth G. Selesky

It is certified that error appears in the above-identified patent and that said Letters Patent is hereby corrected as shown below:

Column 1, line 8, following the words "removing a" insert ---reel of---.

Claim 6 (Column 12, line 14), delete the word "clamp", and substitute therefor ---clasp---.

Claim 9 (Column 12, line 42), delete the word "thereby", and substitute therefor ---therebetween---.

Signed and Sealed this

Twenty-eighth Day of March, 1989

*Attest:*

DONALD J. QUIGG

*Attesting Officer*

*Commissioner of Patents and Trademarks*